US005467502A

United States Patent [19]

Johnson et al.

[11] Patent Number: 5,467,502

[45] Date of Patent: Nov. 21, 1995

[54] HEIGHT ADJUSTING SYSTEM FOR UPRIGHT VACUUM CLEANER

[75] Inventors: Milton J. Johnson, Stanford; Jeffrey T. Roney, Perryville, both of Ky.

[73] Assignee: Matsushita Applicane Corporation, Danville, Ky.

[21] Appl. No.: 205,893

[22] Filed: Mar. 2, 1994

Related U.S. Application Data

[62] Division of Ser. No. 893,267, Jun. 4, 1992, Pat. No. 5,331, 715.

[51] Int. Cl.[6] ..... A47L 5/34

[52] U.S. Cl. ..... 15/339; 15/323; 15/332; 15/354; 15/377

[58] Field of Search ..... 15/323, 331–335, 15/339, 354–356, 377

[56] References Cited

U.S. PATENT DOCUMENTS

| | | | |
|---|---|---|---|
| 2,148,656 | 2/1939 | Smellie | 15/332 |
| 2,218,180 | 10/1940 | Schug . | |
| 2,502,674 | 4/1950 | Sellers | 15/332 |
| 3,391,418 | 7/1968 | Jonsson | 15/319 |
| 3,654,661 | 4/1972 | Scott | 15/354 |
| 4,706,327 | 11/1987 | Getz et al. | 15/354 |
| 4,748,714 | 6/1988 | Tschudy | 15/332 |

*Primary Examiner*—Mark Spisich
*Attorney, Agent, or Firm*—Amster, Rothstein & Ebenstein

[57] ABSTRACT

An upright vacuum cleaner including a canister assembly pivotally connected to a nozzle assembly and an extensible hose which forms part of the vacuum path between the nozzle assembly and the canister assembly and which can be disconnected from the nozzle assembly for above-the-floor cleaning. Disconnecting the hose deenergizes an agitator motor in the nozzle assembly. The canister assembly includes a housing with an integral hand tool and attachment storage area which retains the tools and attachments, as well as the extensible hose, within the periphery of the housing. The upright vacuum cleaner also includes a height adjustment mechanism which deenergizes the agitator motor when the nozzle assembly is in its closest relation to the floor surface being cleaned.

12 Claims, 8 Drawing Sheets

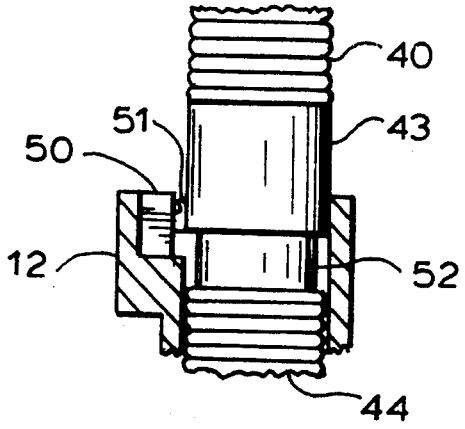
FIG. 4
FIG. 7
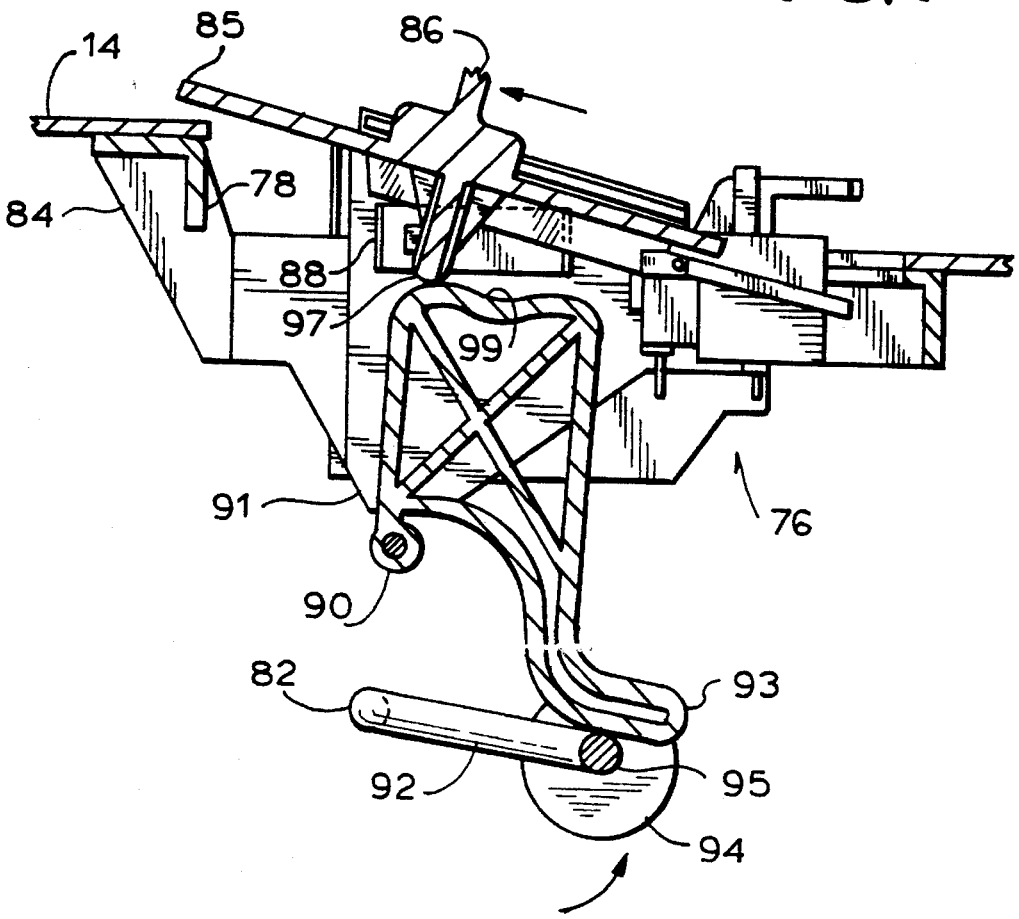

HEIGHT ADJUSTING SYSTEM FOR UPRIGHT VACUUM CLEANER

This a divisional of application Ser. No. 07,893,267 filed on Jun. 4, 1992, now U.S. Pat No. 5,331,715.

BRIEF DESCRIPTION OF THE INVENTION

The present invention relates to an upright vacuum cleaner incorporating new features and conveniences. The upright vacuum cleaner of the present invention includes a canister assembly in operative relation to a nozzle assembly, an extensible hose which forms the vacuum path from the nozzle assembly to the canister assembly and which can be disconnected for above-the-floor cleaning, an integral tool storage and extensible hose retaining area incorporated within the periphery of the housing to the canister assembly, and a nozzle assembly height adjustment mechanism which deenergizes the agitator motor when the agitator brush is positioned such that it is in its closest relation to the floor surface being cleaned. The present invention further incorporates a switch which deenergizes the agitator motor in the nozzle assembly when the extensible hose is disconnected for above-the-floor cleaning.

BACKGROUND OF THE INVENTION

Upright vacuum cleaners which are convertible for cleaning surfaces above a floor surface (i.e., above-the-floor cleaning) are well know in the prior art. For example, U.S. Pat. No. 2,898,621 discloses a conversion arrangement for an upright vacuum cleaner. Typically, and as is taught by U.S. Pat. No. 2,898,621, the suction hose permitting conversion extends from the nozzle assembly, around the periphery of the vacuum cleaner housing, to the canister assembly which houses the dust bag. Such an arrangement is disadvantageous because the suction hose can easily become caught on, or entangled in, various surfaces when the vacuum cleaner is manipulated for floor cleaning.

Similarly, U.S. Pat. No. 4,761,850 discloses an upright vacuum cleaner convertible for above-the-floor cleaning with an integral tool storage compartment. Again, the suction hose is disadvantageously arranged because it extends well beyond the periphery of the vacuum cleaner housing.

When operating a convertible upright vacuum cleaner as an above-the-floor vacuum cleaner, it is advantageous to disengage the agitator brush to prevent possible damage to a floor surface that might occur while the vacuum cleaner remains stationary for a prolonged period of time. U.S. Pat. No. 2,502,674 discloses an arrangement whereby an electrical switch responsive to the insertion of a tool for converting the vacuum cleaner for above-the-floor cleaning causes a clutch to disengage the agitator brush upon insertion of the tool. Such an arrangement is complex and costly, requiring numerous additional components in the construction of the agitator brush.

U.S. Pat. No. 2,218,180 discloses an upright vacuum cleaner wherein the agitator brush is oscillated back and forth by an electrical vibrator. A switch responsive to the insertion of a tool used to convert the vacuum cleaner for above-the-floor cleaning causes an open condition in the electrical circuit to the vibrator. This arrangement is disadvantageous because it requires a separate converter tool for above-the-floor cleaning and because a vibration type agitator brush is not effective in loosening dirt embedded in a carpeted surface.

In addition to being able to disengage the agitator brush when operating a convertible upright vacuum cleaner as an above-the-floor vacuum cleaner, it is also advantageous to disengage the agitator brush when cleaning bare floor surfaces to prevent possible scratching. U.S. Pat. No. 3,291,418 discloses a mechanism for sensing the presence of a bare floor surface. A pressure sensing switch mounted within the nozzle housing in proximity to the agitator brush closes the electrical circuit to the agitator motor when a preselected vacuum level is achieved. The vacuum level generated in the nozzle differs depending on the floor surface being cleaned (i.e., a carpeted surface as opposed to bare floors) because a carpeted surface prevents air leaks around the mouth of the nozzle that would otherwise be present when cleaning a bare floor surface. This arrangement is very complex and is not reliable for all surfaces.

SUMMARY OF THE INVENTION

Accordingly, it is broadly an object of the present invention to provide an upright vacuum cleaner which overcomes or avoids one or more of the foregoing disadvantages resulting from the use of prior art vacuum cleaner construction and construction techniques. Specifically, it is within the contemplation of the present invention to provide a new and improved vacuum cleaner construction that is convertible for above-the-floor cleaning wherein the hose used to convert the vacuum cleaner is stored on the housing to the vacuum cleaner such that it does not extend beyond the periphery of the housing.

It is a further object of the present invention to provide an upright vacuum cleaner convertible for above-the-floor cleaning with an integral cleaning tool and attachment storage area wherein the cleaning tools and attachments, as well as the hose used to convert the vacuum cleaner for above-the-floor cleaning, are all stored within the periphery of the housing to the vacuum cleaner.

It is still a further object of the present invention to provide an upright vacuum cleaner wherein the agitator motor is deenergized when the vacuum cleaner is operated as an above-the-floor vacuum cleaner.

It is yet a further object of the present invention to provide an upright vacuum cleaner with a simple mechanism for adjusting the height of the agitator brush.

Yet a further object of the present invention is to provide an upright vacuum cleaner wherein the agitator motor is deenergized in response to the position of the agitator brush relative to the floor surface being cleaned.

Still a further object of the present invention is to provide a modular component for both adjusting the height of the agitator brush and for deenergizing the agitator motor in response to the height of the agitator brush relative to the floor surface.

In the vacuum cleaner constructed in accordance with the present invention there is a canister assembly in operative relation with a nozzle assembly that includes a nozzle which houses an agitator brush driven by an agitator motor and an air suction passageway terminating at the nozzle. A hose connects the air suction passageway in the nozzle to the canister assembly. The hose can be disconnected from the air suction passageway for above-the-floor cleaning. A switch means responsive to the connection of the hose to the air suction passageway without regard to the orientation of the hose relative to the air suction passageway, deenergizes the agitator motor when the hose is disconnected.

The upright vacuum cleaner constructed in accordance with the present invention includes an integral storage area for cleaning tools and attachments. There is provided a canister assembly having a housing with a periphery defined by a top, a bottom and sides of the housing in operative relation with a nozzle assembly, and a hose which connects the nozzle assembly to the canister assembly. A plurality of clamps on the surface of the housing of the canister assembly retain a plurality of cleaning tools within the periphery of the housing. Similarly, resilient arms on the surface of the housing of the canister assembly retain various attachments as well as the hose against the surface of the housing within the periphery of the housing.

The present invention also includes an adjustment apparatus of a vacuum cleaner nozzle assembly, which includes an agitator brush driven by an agitator motor, for controlling the distance of the agitator brush, from the floor surface being cleaned and for deenergizing the agitator motor. A wheel assembly is movably mounted to the nozzle assembly in operative relation to a mechanism for moving the wheel assembly from a first position in which the agitator brush is closest to the floor surface being cleaned to a second position in which the agitator brush is farthest from said floor surface. A switch means responsive to the position of the wheel assembly deenergizes the agitator motor when the wheel assembly is in the first position.

BRIEF DESCRIPTION OF THE DRAWINGS

For a fuller understanding of the objects, features, and advantages of the present invention, reference should be made to the following detailed description of the various preferred, but nonetheless, illustrative embodiments of the invention as illustrated by and taken in conjunction with the accompanying drawings wherein:

FIG. 4 is a fragmentary vertical section showing the switch means of the present invention for deenergizing the agitator motor when the vacuum cleaner is configured for above-the-floor cleaning;

FIG. 7 is the same view of the height adjustment module shown in FIG. 6 except illustrating both the sliding motion of the actuator and the position of the actuator when the nozzle assembly is closest to the floor surface being cleaned;

DETAILED DESCRIPTION OF THE PREFERRED EMBODIMENT

Figure 1:
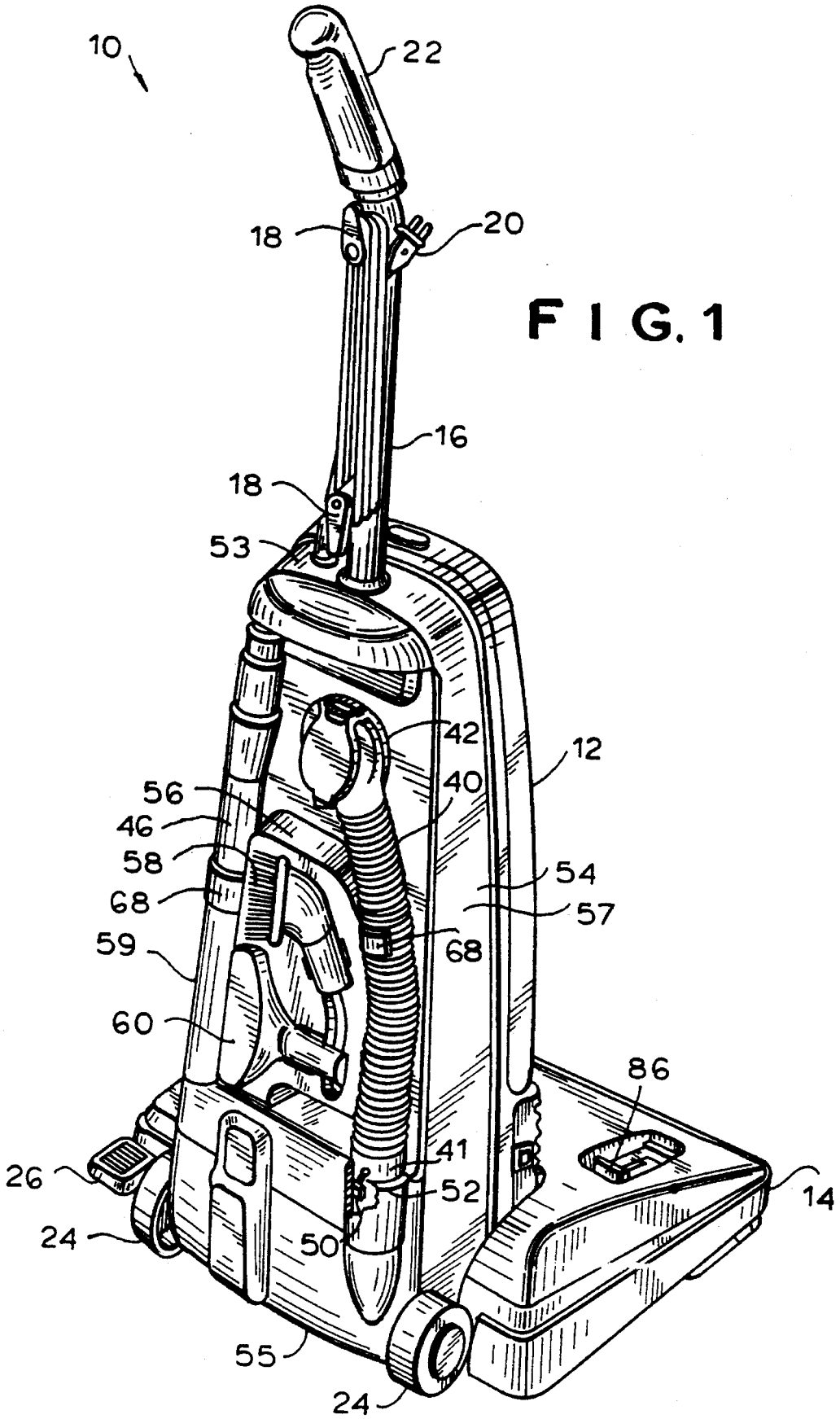
FIG. 1 is a perspective view of an upright vacuum cleaner incorporating various objects, features and advantages of the present invention.

In the exemplary embodiment of the invention as disclosed in the drawings, there is shown in FIG. 1 an upright vacuum cleaner generally designated by the reference numeral 10 constructed in accordance with the principles of the present invention, including a canister assembly 12 pivotally connected to a nozzle assembly 14 by a hinge assembly (not shown). Rigidly attached to the top of the canister assembly 12 is a handle 16 which includes cord posts 18, 18 for storing power cord 20 which provides electrical energy to the vacuum cleaner 10 and an angled handgrip 22 for manipulation of the vacuum cleaner 10 during floor cleaning.

At the lower portion of canister assembly 12, rear wheels 24, 24 are provided to support the weight of vacuum cleaner 10 and to provide a pivot point about which the nozzle assembly 14 pivots when the height of the nozzle assembly 14 is adjusted by the height adjustment means 76 in accordance with one of the preferred embodiments of the present invention described below. As is commonly understood in the art, a foot latch 26 locks the canister assembly 12 in the upright position for storage and off the floor cleaning, permitting the canister assembly 12 to pivot relative to the nozzle assembly 14 only when the operator depresses foot latch 26 thereby releasing the canister assembly 12.

Figure 2:
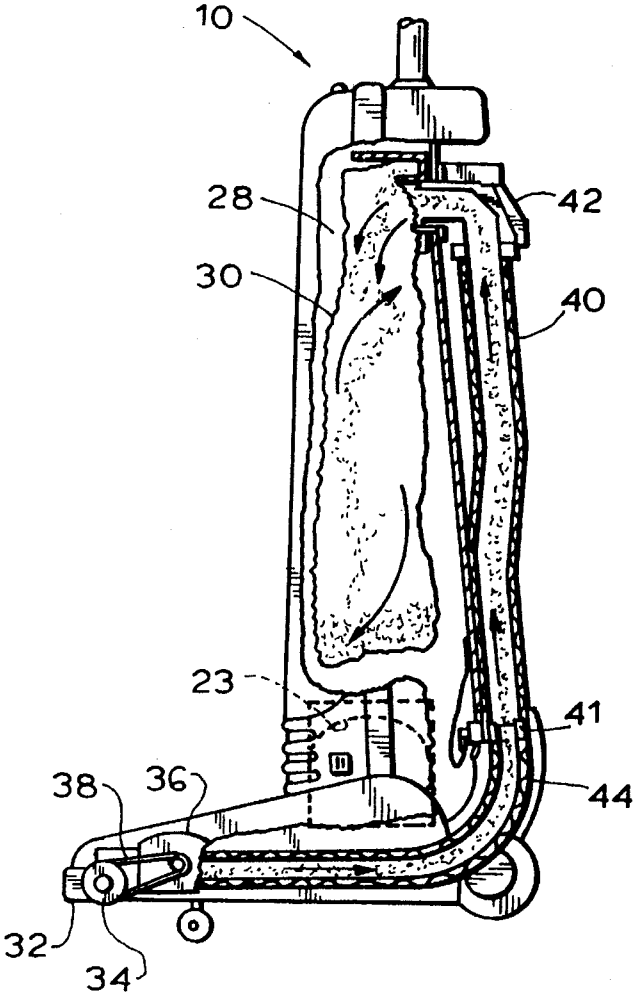
FIG. 2 is a side view of the upright vacuum cleaner of the present invention schematically illustrating the air flow path when the vacuum cleaner is configured for floor cleaning.
Figure 5:
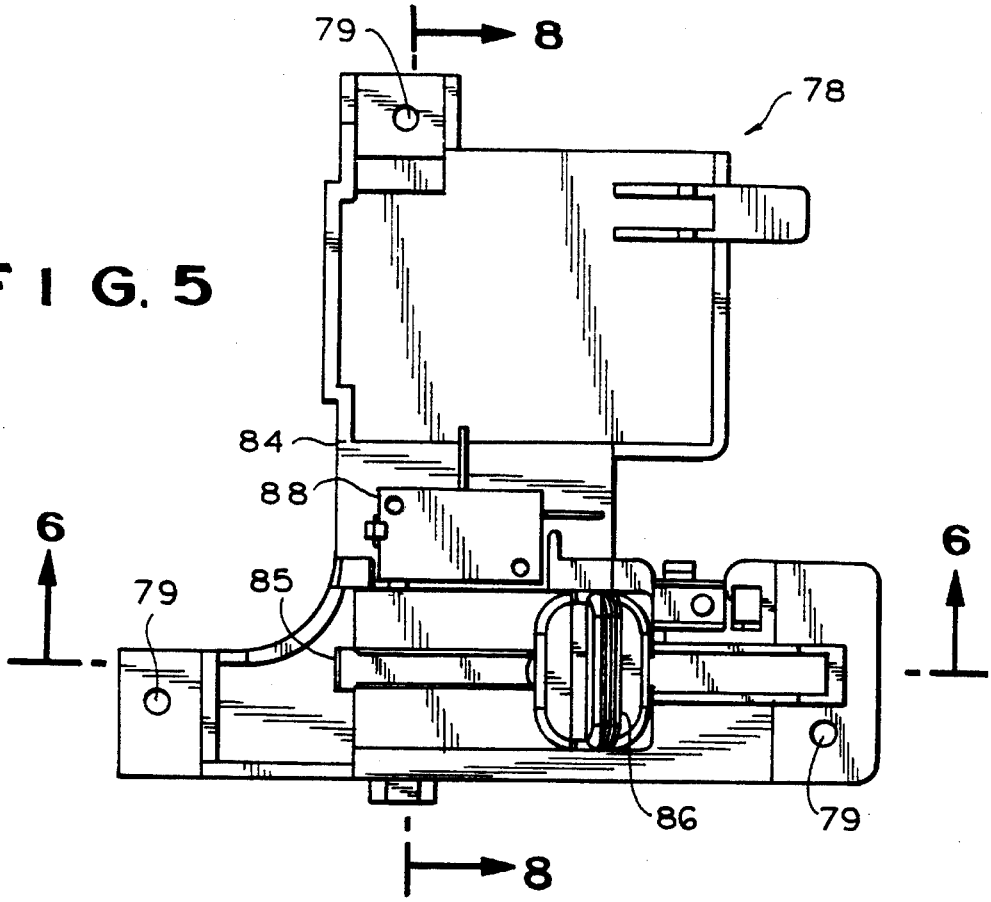
FIG. 5 is a top view of the height adjustment module of the present invention illustrating the position of the actuator when the nozzle assembly is farthest from the floor surface being cleaned.

Canister assembly 12 includes a suction motor 23 which is arranged in a manner well known in the art for the construction of canister type vacuum cleaners whereby the suction motor 23 creates a negative pressure or suction in a chamber 28, shown schematically in FIG. 2, which houses a dust bag 30. The suction motor 23 thereby draws dirt laden air into chamber 28 and through the porous walls of dust bag 30, trapping suspended dirt and particles inside dust bag 30.

The suction motor 23 is activated by the operation of power switch 31 (See FIG. 13) located adjacent the handle 22. In normal floor cleaning operation, activation of the power switch 31 causes both the suction motor 23 and the agitator motor 36 to become activated.

Nozzle assembly 14 includes, at its front portion, a nozzle 32 which houses a rotating agitator brush 34. Agitator brush 34 is rotatably driven by an agitator motor 36 though a belt and pulley arrangement 38 common in the art. As is commonly understood, the agitator brush 34 serves to loosen trapped dirt and particulate matter in a carpeted floor surface.

The suction or negative pressure created by the suction motor 23 in the chamber 28 of the canister assembly 12 is communicated to the nozzle assembly 14 by an extensible hose 40. Extensible hose 40 is swivelly connected to the chamber 28 of the canister assembly 12 by swivel port 42.

Swivel port 42 is constructed in accordance with principles well known in the art which are taught, for example, in U.S. Pat. No. 4,550,958, so as to permit full rotation of the extensible hose 40 about the canister assembly 12 while providing a substantially vacuum tight seal between the chamber 28 of canister assembly 12 and the extensible hose 40. Swivel port 42 engages the dust bag 30 in a manner commonly known in the art.

The free end 41 of the extensible hose 40 telescopically mates with flexible hose 44 which serves to provide a flexible and substantially vacuum tight coupling, without the use of sealing elements, that permits the canister assembly 12 to pivot relative to the nozzle assembly 14 while airflow is directed from the nozzle 32 of the nozzle assembly 14 to the extensible hose 40 and thereby into the dust bag 30 located in chamber 28 of the canister assembly 12. The connection between the extensible hose 40 and the flexible hose 44 is also substantially vacuum tight.

As shown in FIG. 2, when the free end 41 of extensible hose 40 is mated with flexible hose 44, the upright vacuum cleaner 10 is configured for floor cleaning. In this configuration, dirt laden air is drawn from the nozzle 32 of nozzle assembly 14 through flexible hose 44 into extensible hose 40 and thereafter through swivel port 42 into dust bag 30 located in chamber 28 of the canister assembly 12.

Figure 3:
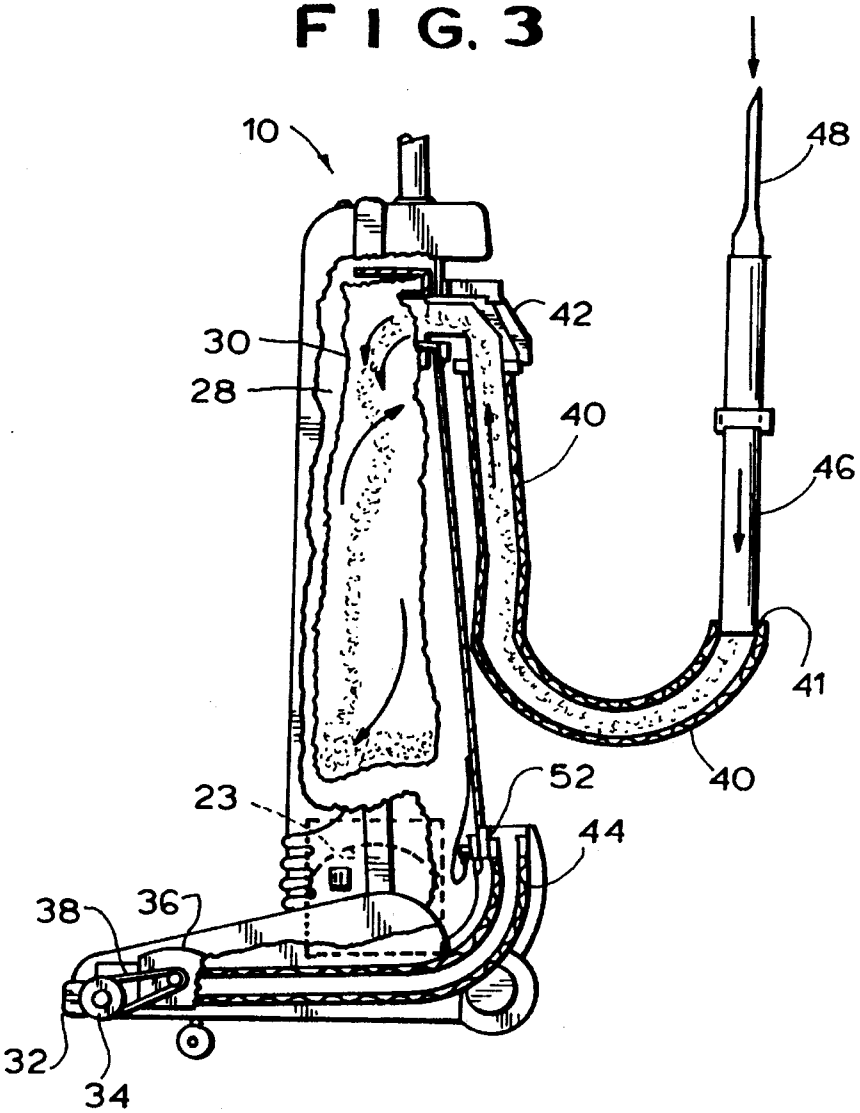
FIG. 3 is a side view of the upright vacuum cleaner of the present invention schematically illustrating the air flow path when the vacuum cleaner is configured for above-the-floor cleaning.

As shown in FIG. 3, vacuum cleaner 10 can also be configured for above-the-floor cleaning by disconnecting the free end 41 of extensible hose 40 from the flexible hose The free end 41 can then be connected to any one of a plurality of possible hand cleaning tools and attachments. For example, as shown in FIG. 3, the extensible hose 40 can be mated with a telescoping wand 46 which is connected to a crevice tool When configured for above-the-floor cleaning, dirt laden air is drawn from a preselected hand cleaning tool or attachment, for example, the crevice tool 48 and telescoping wand 46, through the extensible hose 40 to swivel port 42 wand thereafter into dust bag 30 located in chamber 28 of the canister assembly 12.

To facilitate above-the-floor cleaning, the extensible hose 40 is designed to extend to several times its collapsed length. Furthermore, the extensible hose 40 is made of a relatively light weight material, such as plastic, to permit its easy manipulation. Swivel port 42 further facilitates the manipulation of the extensible hose 40 during above-the-floor cleaning by permitting full rotation of extensible hose 40 relative to the canister assembly 12.

When the vacuum cleaner 10 is configured for above-the-floor cleaning, it is advantageous to stop the rotation of the agitator brush 34 in the nozzle assembly 14 so that the floor surface beneath the agitator brush 34 does not become damaged while the vacuum cleaner 10 remains in one position for an extended length of time. The present invention contemplates deenergizing the agitator motor 36 which rotatively drives the agitator brush 34 whenever the extensible hose 40 is disconnected from the flexible hose 44. This feature also reduces the power consumed by the vacuum cleaner 10.

Figure 13:
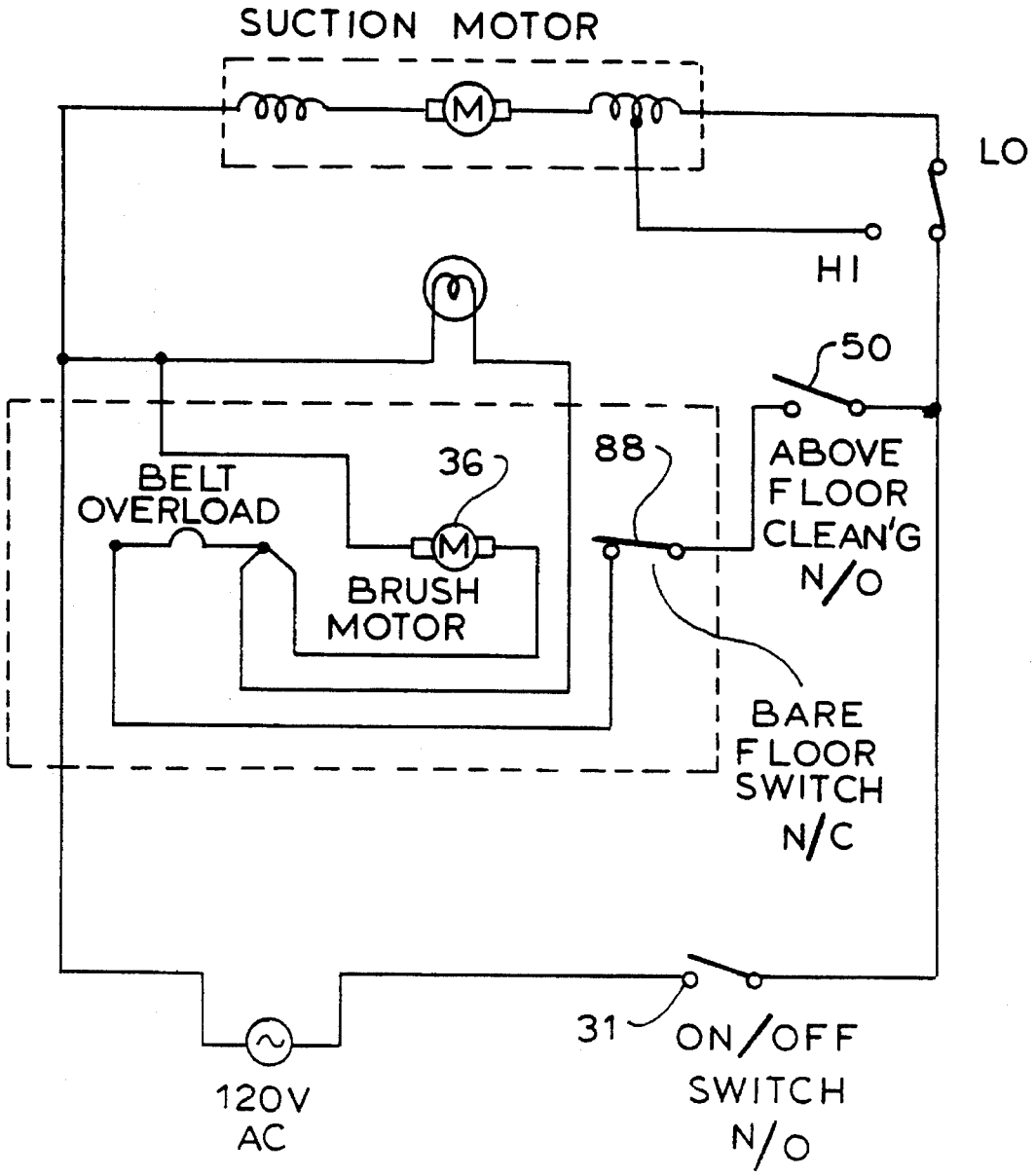
FIG. 13 is an electrical schematic illustrating the electrical connection of the switches employed in the present invention for deenergizing the agitator motor when the vacuum is configured for above-the-floor cleaning and for deenergizing the agitator motor when the vacuum cleaner is used to clean bare floor surfaces.

Deenergization of the agitator motor 36 is accomplished by a microswitch 50 which is incorporated in canister assembly 12. As shown in FIG. 13, the microswitch 50 is electrically connected in series with the agitator motor 36. Microswitch 50 is normally open, thereby completing the circuit and causing rotation of the agitator motor 36 only when microswitch 50 is activated.

As shown in FIG. 4, the microswitch 50 is physically attached to the canister assembly 12 inside the nozzle vacuum port 52 such that the collar 43 of the extensible hose 40 engages a switch cam 51 on the microswitch 50 thereby activating the microswitch 50 whenever the extensible hose 40 is mated with the flexible hose 44, closing the circuit to the agitator motor 36 and energizing the motor. Because microswitch 50 is activated by the axially symmetric collar 43 of the extensible hose 40, the angular orientation of extensible hose 40 does not affect the deenergization and energization of the agitator motor 36. The operation of the microswitch 50 does not affect the energization or deenergization of the suction motor 23.

When using the vacuum cleaner 10 as an above-the-floor cleaner, it is advantageous to use various hand held cleaning tools and attachments as would be commonly used for canister type vacuum cleaners well known in the art. It is further advantageous to have a storage area on the vacuum cleaner for storing said hand held cleaning tools and attachments in such a way as to allow easy access without having protruding surfaces which can be caught on objects while the vacuum cleaner 10 is manipulated during floor cleaning. In particular, it is advantageous to store the extensible hose 40 within the periphery of the canister assembly 12 because the hose could easily become caught on objects when the vacuum cleaner 10 is manipulated while configured for floor cleaning.

As shown in FIG. 1, the canister assembly 12 of the present invention includes a canister housing 54 with top and bottom surfaces 53 and 55, respectively, as well as sides 57 and 59 all cooperating to define a periphery of the canister housing 54. Canister housing 54 further includes a surface with provisions for storing various hand held cleaning tools and attachments as well as for retaining the extensible hose 40 when the vacuum cleaner 10 is configured for floor cleaning.

Specifically, the canister housing 54 includes a storage area 56 within the periphery of the canister housing 54 for releasably storing a brush 58 and a hand nozzle 60. A telescoping wand 46, used to facilitate above-the-floor cleaning, is releasably stored along side storage area 56 within the periphery of the housing 54 as defined by top surface 53, bottom surface 55 and sides 57, 59. Finally, the extensible hose 40 is retained on the surface of the canister housing 54 within its periphery when the vacuum cleaner 10 is configured for floor cleaning by a resilient arm 68 which retains the hose 40 against the surface of the canister housing 54 as described below.

Figure 12:
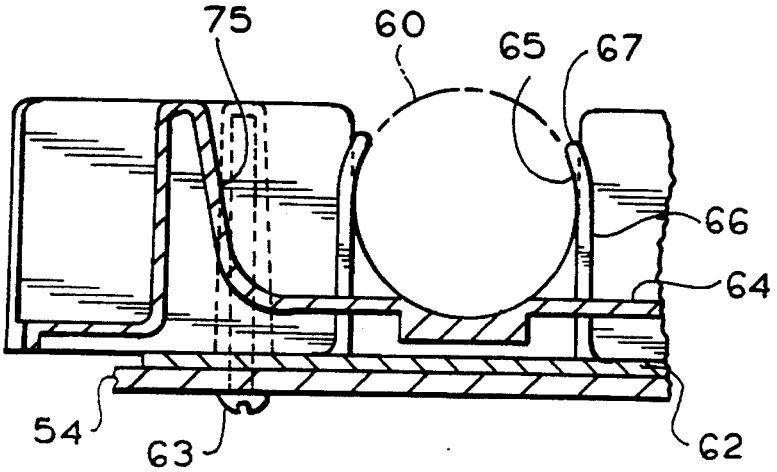
FIG. 12 is a fragmentary vertical cross section of the storage area of the present invention taken along the line 12—12 in FIG. 11, illustrating the retention of the hand nozzle.
Figure 11:
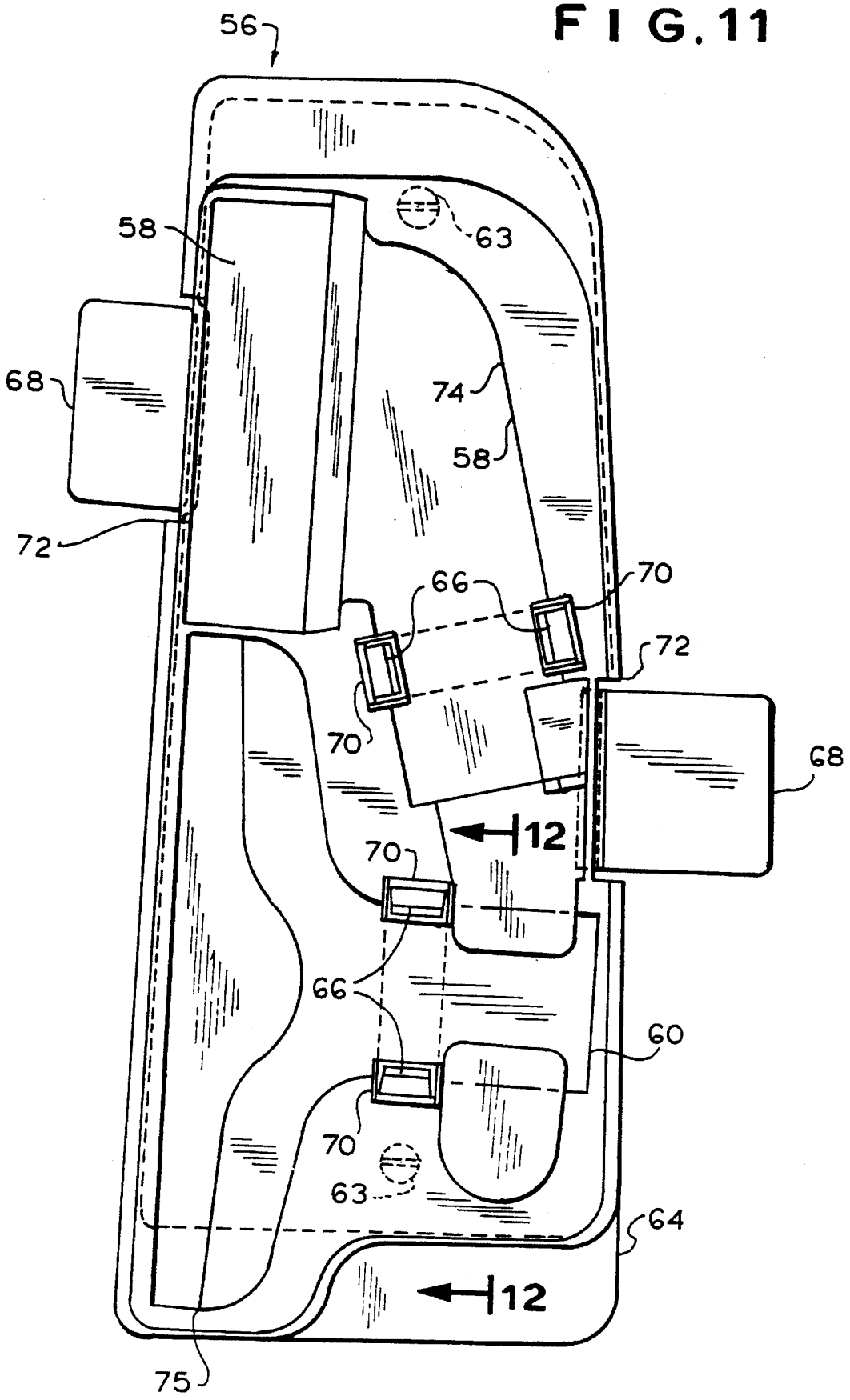
FIG. 11 is a side view of the storage area for hand held cleaning tools, in particular, a brush and a hand nozzle, incorporated in the vacuum cleaner of the present invention.

As shown in FIGS. 11 and 12, storage of the brush 58 and the hand nozzle 60 is accomplished by a plate 62 in conjunction with a storage tray 64. Storage of the telescoping wand 46 and retention of the extensible hose 40 is accomplished by the plate 62.

Plate 62 is mounted to the canister housing 54 beneath the storage tray 64 by means of securing screws 63, 63. Plate 62 is preferably molded from a resilient plastic and includes clamps formed by two sets of opposing resilient fingers 66, 66 and resilient arms 68, 68. Tray 64 is preferably molded from a relatively stiff plastic and includes slots 70, 70 which accept the resilient fingers 66, 66 on plate 62 when tray 64 is mounted above the plate 62 to form storage area 56, as well as notched portions 72, 72 which accept the resilient arms 68, 68 on plate 62. Tray 64 further includes a molded recess 74 to accommodate the brush 58 and a molded recess 75 to accommodate the hand nozzle 60.

As shown in FIG. 12, each resilient finger 66 includes a retaining portion 65 and a mouth portion 67. Retaining portions 65, 65 on opposing resilient fingers 66, 66 cooperate to clamp a circular shape with a diameter substantially equal to the distance separating the resilient fingers 66, 66. Mouth portions 67, 67 are rounded to cause the opposing resilient fingers 66, 66 to move apart when a circular shape of the aforesaid diameter is introduced.

Thus, for example, when hand nozzle 60 is to be stored within the storage area 56, the operator aligns the hand nozzle 60 with the contour of the molded recess 75 in storage tray 64 and then forces the hand nozzle 60 into the molded recess 75 thereby causing mouth portions 67, 67 of opposing resilient fingers 66, 66 to move apart until the hand nozzle 60 is seated whereby the retaining portions 65, 65 of opposing resilient fingers 66, 66 clamp the hand nozzle 60 in place. The hand nozzle 60 is removed by simply pulling it away from the storage tray 64 thereby causing resilient fingers 66, 66 to move apart until the hand nozzle 60 is withdrawn and the resilient fingers 66, 66 move back to their relaxed position.

As shown in FIGS. 1 and 11, the resilient arms 68, 68 are hook shaped and accommodate circular shapes of the correct size. Resilient arms 68, 68 operate to clamp the telescoping wand 46 and the extensible hose 40 by trapping them against the surface of the canister housing 54. That is, for example, the extensible hose 40 is secured by displacing resilient arm 68 away from the canister housing 54 and thereby creating sufficient space to insert the extensible hose 40 into engagement with resilient arm 68. As extensible hose 40 nears its fully seated position in the resilient arm 68, resilient arm 68 moves back to its relaxed position and clamps the extensible hose 40 against the canister housing 54 within the periphery of canister housing 54 as defined by top surface 53, bottom surface 55 and sides 57, 59.

When the various hand cleaning tools and attachments are stored in the storage area 56 and the vacuum cleaner 10 is operated as a floor cleaner, it is advantageous to adjust the height of the agitator brush 34 above the floor surface depending on the type of surface being cleaned. It is well known in the art that for cleaning carpet, the preferred height of the agitator brush 34 is directly related to the height of the carpet pile. The agitator brush 34 should be higher when cleaning a high pile or deep shag carpet than when cleaning a low pile carpet. It is further known in the art that for bare floor surfaces, the agitator brush 34 should not rotate because such rotation can scratch a bare floor surface. The height of the agitator brush 34 is adjusted by changing the position of the nozzle assembly 14 relative to the floor surface.

As shown in FIGS. 5 through 10, the present invention contemplates an improved height adjustment means 76 which includes a height adjustment module 78, a cam body 80 and a front wheel assembly 82. The height adjustment means 76 permits an operator to adjust the distance of the agitator brush 34 of the nozzle assembly 14 from the floor surface being cleaned and also, to simultaneously deenergize the agitator motor 36 when the agitator brush 34 is in its lowest position relative to the floor surface being cleaned.

The height adjustment module 78 includes a housing 84 which is preferably molded from plastic, an actuator 86 and a microswitch 88 mounted in operative relation to the actuator 86. Actuator 86 includes a rail 85 that slides within a C-shaped channel 87 formed in the top surface of the housing 84. Actuator 86 also includes an integrally molded resilient positioning arm 89 on its bottom surface. When actuator 86 is slid into C-shaped channel 87, the resilient positioning arm 89 engages detents 88, 88 on the undersurface of the housing 84 thereby retaining the actuator 86 in a preselected position. Resilient positioning arm 89 deforms to move out of engagement with a preselected detent 88 when sufficient axial force is applied to the actuator 86.

Cam body 80 is pivotally connected to the nozzle assembly 14 by a pivot rod 90 which rests in a groove (not shown) in the nozzle assembly 14. Pivot rod 90 is rotatably secured in the groove by strut 91 of the housing 84 when the height adjustment module 78 is secured to the nozzle assembly 14 by means of self-tapping screws (not shown) through holes 79, 79 in the height adjustment module 78. Leg 93 of the cam body 80 rests on one outer arm 95 of offset axle 92 which is journalled to the nozzle assembly 14 at its center. Rotatably attached to each outer arm 95 of the offset axle 92 are front wheels 94, 94 which rest on the floor surface being cleaned (not shown). Thus, rotation of the offset axle 92 causes the front wheels 94, 94 to move inwardly and outwardly relative to the nozzle assembly 14. As the front wheels 94, 94 move inwardly and outwardly, the front of the nozzle assembly 14 is caused to rotate about the rear wheels 24, 24 causing the agitator brush 34 to move closer or further from the floor surface.

Figure 6:
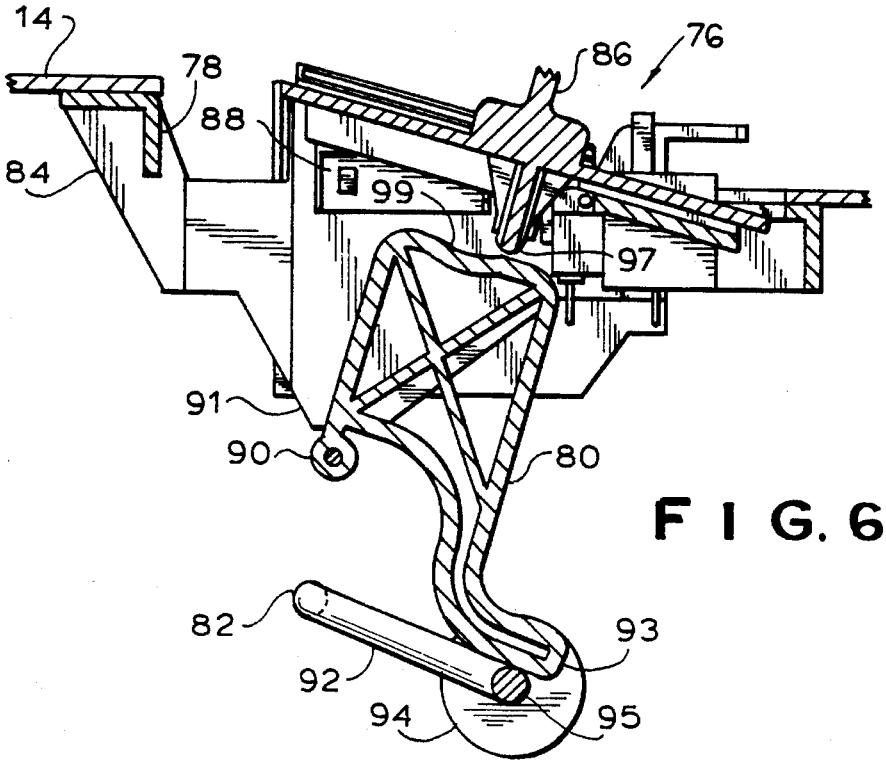
FIG. 6 is a vertical cross section of the height adjustment module taken along the line 6—6 in FIG. 5, illustrating the height adjustment module installed in the nozzle assembly of the vacuum cleaner of the present invention.
Figure 8:
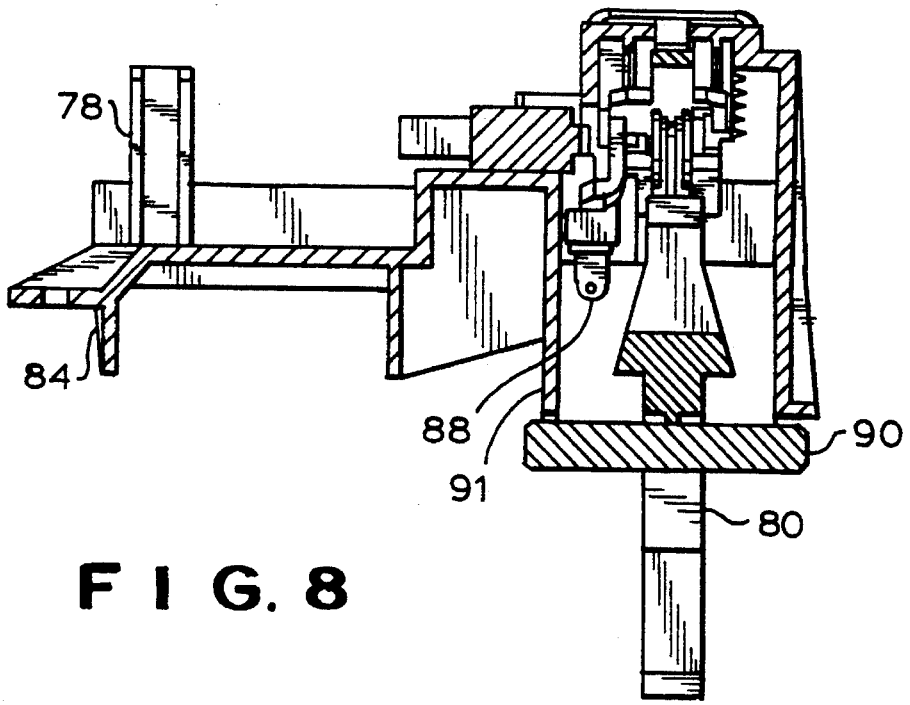
FIG. 8 is a vertical cross section of the height adjustment module taken along the line 8—8 in FIG. 5.
Figure 9:
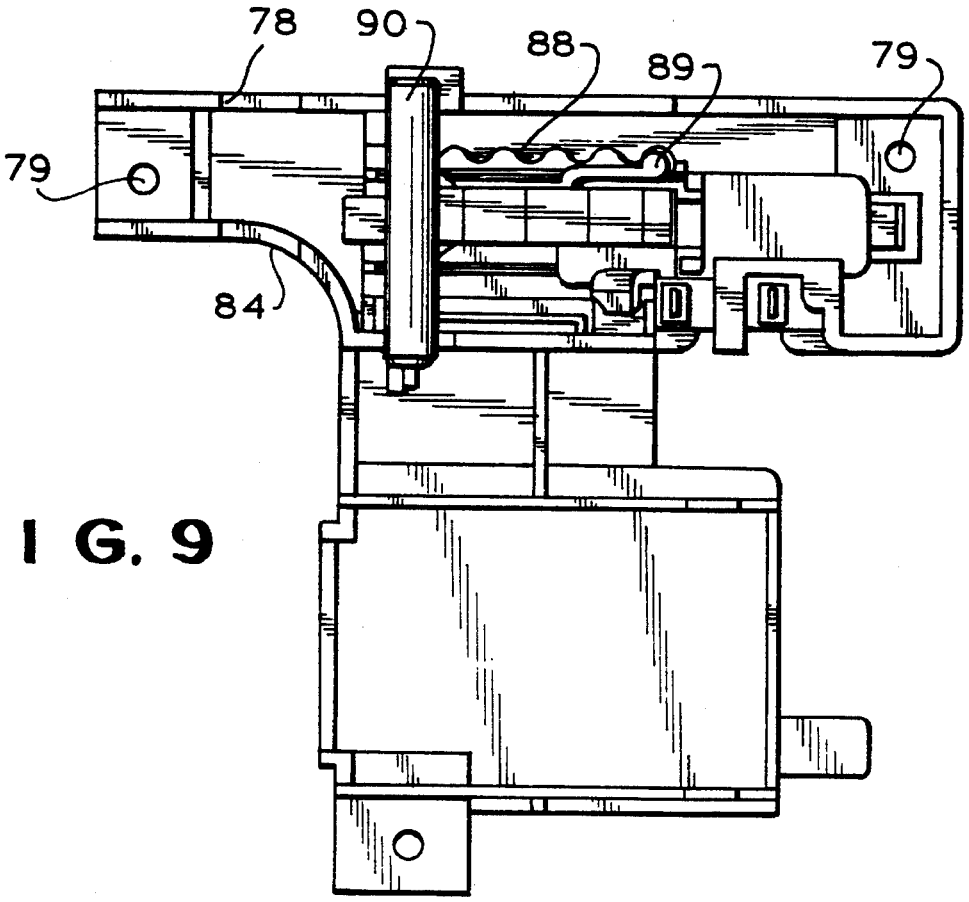
FIG. 9 is a bottom view of the height adjustment module.
Figure 10:
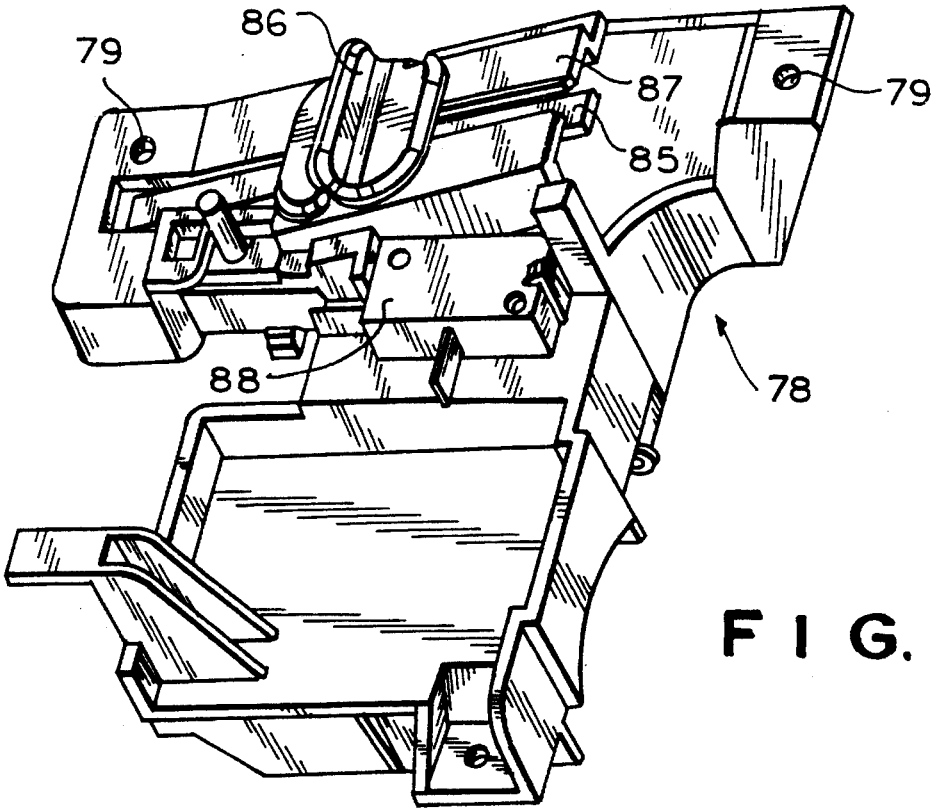
FIG. 10 is a perspective view of the height adjustment module.

As best shown in FIG. 6, actuator 86 slides along the C-shaped channel 87 which is inclined relative to the floor surface. A cam follower 97 molded as part of the actuator 86 contacts camming surface 99 of the cam body 80 which is biased against the cam follower 97 by the weight of the vacuum cleaner 10. In turn, the outer arm 95 of the offset axle 92 is held against leg 93 of the cam body 80 thereby biasing the camming surface 99 of the cam body 80 against the cam follower 97. When the actuator 86 is moved along the C-shaped channel 87 to a different position, the cam follower 97 slides along camming surface 99, causing the cam body 80 to rotate relative to the nozzle assembly 14 by virtue of both the profile of the camming surface 99 and the angle of inclination of the C-shaped channel 87. Rotation of the cam body 80 causes leg 93 of cam body 80 to displace the outer leg 95 of the offset axle 92 relative to the nozzle assembly 14 and thereby adjust the height of the nozzle assembly 14 and, in particular, the agitator brush 34, relative to the floor surface.

In operation, actuator 86 is capable of moving from a first position, shown in FIG. 7, wherein the agitator brush. 34 is closest to the floor surface, to a second position, shown in FIG. 6, wherein the agitator brush 34 is farthest from the floor surface. For bare floor cleaning, the lowest position is most advantageous because the vacuum force is applied immediately adjacent to the floor.

The microswitch 88 mounted in operative relation with actuator 86 on housing 84 energizes and deenergizes the agitator motor 36 in response to the position of the nozzle assembly 14. Specifically, the microswitch 88 is arranged such that the cam follower 97 of actuator 86 engages the microswitch 88 when the actuator 86 is in the first or lowest position as shown in FIG. 7.

As shown schematically in FIG. 13, the microswitch 88 is electrically connected in series with the agitator motor 36 such that the circuit is normally closed. When the microswitch 88 is activated by the cam follower 97 of actuator 86, microswitch 88 causes an open condition in the circuit to the agitator motor 36 thereby deenergizing the agitator motor 36 when the nozzle assembly 14 is in its closest relation to the floor surface being cleaned.

Although the invention disclosed herein has been described with reference to particular embodiments, it is to be understood that these embodiments are merely illustrative of the different aspects and features of the invention. As such, a person skilled in the art may make numerous modifications to the illustrative embodiments described herein, and other arrangements may be devised to implement the invention, without departing from the spirit and scope of the invention as disclosed and claimed.

What we claim is:

1. An adjustment apparatus of a vacuum cleaner nozzle assembly which includes an agitator brush driven by an agitator motor for controlling the distance of the agitator brush from the floor surface being cleaned and for deenergizing the agitator motor, comprising:

a wheel assembly movably mounted to the nozzle assembly for supporting the agitator brush above the floor surface;

means for moving the wheel assembly from a first position wherein the agitator brush is closest to the floor to a second position wherein the agitator brush is furthest from the floor; and a switching means responsive to the means for moving the wheel assembly which deenergizes the agitator motor when the wheel assembly is in the first position.

2. The adjustment apparatus of claim 1 wherein the switching means is a normally closed switch in operative relationship to the agitator motor.

3. The adjustment apparatus of claim 1 further including a plurality of positions between the first position and the second position and means for maintaining the wheel assembly moving means in one of the plurality of positions.

4. The adjustment apparatus of claim 3 wherein the means for maintaining the position of the wheel assembly moving means is comprised of a resilient arm on the wheel assembly moving means which engages and disengages a series of detents operatively arranged in the wheel assembly moving means.

5. The adjustment apparatus of claim 1 wherein the means for moving the wheel assembly is comprised of a cam follower which actuates a cam body mounted in engaging relation to the wheel assembly.

6. The adjustment apparatus of claim 5 wherein the cam follower slides in a substantially linear direction.

7. The adjustment apparatus of claim 6 further including a resilient arm in operative relation to the cam follower; and a plurality of detents arranged for engagement with and disengagement from the resilient arm such that the cam follower is releasably retained in one of a plurality of positions.

8. The adjustment apparatus of claim 7 wherein the wheel assembly is comprised of an offset axle with one wheel rotatively mounted on each free end of the offset axle.

9. In a vacuum cleaner nozzle assembly including an agitator brush driven by an agitator motor, a switch for energizing and deenergizing the agitator motor, and an adjustment assembly for adjusting the position of the agitator brush relative to the floor surface being cleaned, the improvement comprising:

means mechanically connecting the switch to the adjustment assembly such that the switch deenergizes the agitator motor when the adjustment assembly is positioned such that the agitator brush is closest to the floor surface being cleaned.

10. A modular assembly for adjusting the height of a nozzle assembly in an upright vacuum cleaner, comprising:

a frame member adapted to be mechanically secured to the nozzle assembly;

a cam follower mounted on the frame member such that the cam follower is movable within the frame member in a substantially linear direction through a plurality of positions;

a nozzle supporting means having a camming surface which is engaged by the cam follower such that the nozzle supporting means is movable by the cam follower through a plurality of positions to vary the height of the nozzle assembly; and, a switching means mounted on the frame member in operative relation to the cam follower such that the switching means is engaged by the cam follower in at least one position of the cam follower.

11. The modular assembly of claim 10 further including a means for maintaining the position of the cam follower relative to the frame member.

12. The modular assembly of claim 11 wherein the means for maintaining the position of the cam follower is comprised of:

a resilient arm in operative relation to the cam follower; and a plurality of detents arranged for engagement with and disengagement from the resilient arm such that the cam follower is retained in one of a plurality of positions.

* * * * *